United States Patent [19]

Flinchbaugh, deceased

[11] 4,332,110

[45] Jun. 1, 1982

[54] AUTOMATICALLY ADJUSTABLE GRINDING WHEEL

[75] Inventor: Donald E. Flinchbaugh, deceased, late of York, Pa., by Anna M. Flinchbaugh, executrix

[73] Assignee: Weldon Hydraulics, Inc., York, Pa.

[21] Appl. No.: 146,490

[22] Filed: May 5, 1980

[51] Int. Cl.[3] ..... B24B 49/00

[52] U.S. Cl. ..... 51/165.78; 74/526

[58] Field of Search ..... 51/165.78, 165.79, 165.93, 51/165.87; 74/526

[56] References Cited

U.S. PATENT DOCUMENTS

| | | | |
|---|---|---|---|
| 1,659,544 | 2/1928 | Dodge | 74/526 |
| 2,028,642 | 1/1936 | Arter | 51/165.79 |
| 3,222,823 | 12/1965 | Seidel | 51/165.87 |
| 3,513,596 | 5/1970 | Beauchet | 51/165.87 |
| 3,959,930 | 6/1976 | Hatta | 51/165.87 |
| 4,074,467 | 2/1978 | Robillard | 51/165.93 |
| 4,123,878 | 11/1978 | Lizotte | 51/165.87 |

*Primary Examiner*—Harold D. Whitehead

*Attorney, Agent, or Firm*—Harding, Earley, Follmer & Frailey

[57] ABSTRACT

An abrasive grinding machine wherein the periphery of a rotatable grinding wheel always is returned to, and during grinding maintained at, a constant and precise workpiece grinding position irrespective of the reduction of the diameter of the wheel from wear and/or dressing. The grinding wheel is mounted rotatably on the distal end of a rockable pivot arm which, during grinding, is actuated periodically to retract the wheel from and return it to workpiece grinding position. A control mechanism, constituted by a fixed stop on the pivot arm, a moveable cam for the stop and a programmable drive motor for the cam, is operative periodically, in harmony with the reciprocable movement of the pivot arm, to adjust the cam relative to the stop to permit controlled, incremental increases in the distance over which the grinding wheel is periodically retracted from and returned to workpiece grinding position. The invention finds particular use in conjunction with dressing tools or wheels for a grinding machine. It provides for the selectively controlled, automatic and periodic dressing of a grinding wheel, to retrue its worn periphery repetitively throughout the useful life of the grinding wheel, and while the grinding machine is carrying out an abrasive grinding operation.

9 Claims, 4 Drawing Figures

AUTOMATICALLY ADJUSTABLE GRINDING WHEEL

FIELD OF THE INVENTION

This invention pertains to abrasive grinding machines wherein a rotatable grinding wheel is provided with means automatically operable to ensure that the wheel is returned to, and maintained at, a constant and precise workpiece grinding position, irrespective of variations in conditions of use which might effect the grinding wheel such as, for example, reduction of its diameter from wear and/or dressing.

Various mechanisms have been developed which provide for the automatic dressing of a grinding wheel during the grinding operation. Examples of such mechanisms may be found in the following United States patents: Nos. 1,666,237, 3,634,997, 3,668,812, 4,082,014 and 4,143,637. But so far as is known, an automatically adjustable, periodically actuated, precision-controlled mechanism has not been developed which permits the continuous, incremental dressing of a grinding wheel, throughout its useful life, and during grinding machine operation, which is automatically operative to retract the grinding wheel to dressing position and then restore it, with compensatory adjustment proportional to the reduction of the wheel, to a constant and precise workpiece grinding position. While a retractable support for a grinding wheel is known per se, as illustrated in U.S. Pat. No. 4,130,967, such a support means has not been developed for use in a grinding machine operation whereby the grinding wheel may be periodically retracted from, and advanced to, workpiece grinding position, with selected and controlled incremental adjustments in the reciprocatory range of movement of the wheel, to compensate automatically for changes in conditions of operation, such as the reduction of the grinding wheel.

SUMMARY OF THE INVENTION

A primary object of this invention is to provide a new, improved, more efficient, more reliable, automatically adjustable and periodically actuated mechanism for an abrasive grinding wheel which ensures that, throughout its useful life, the periphery of the wheel always is returned to, and maintained at, a constant and precise workpiece grinding position irrespective of the reduction of the diameter of the grinding wheel from wear/or dressing, or of the occurrence of other conditions arising during the operation of the grinding machine.

A further object of the invention is to provide a novel, precision-controlled, adjustment mechanism for a grinding wheel used in an abrasive grinding machine, wherein the wheel is mounted for selected and periodic reciprocation away from and toward workpiece grinding position accompanied by automatic and concomitant incremental adjustments in the stroke or range of wheel movement, as necessary or desired, to ensure that the periphery of the grinding wheel always is restored to a constant, precise workpiece grinding position.

A further object of the invention is to provide an automatic adjustment mechanism for a grinding wheel which provides for the periodic, selected dressing of a grinding wheel during the grinding operation by the cyclic retraction of the grinding wheel from workpiece grinding position to wheel dressing position and the subsequent restoration of the grinding wheel to workpiece grinding position, with incremental adjustment to the return stroke of the grinding wheel to compensate for the reduction of the wheel due to the dressing operation.

A further object is to provide an automatically controlled compensating means for a grinding wheel which provides for restoring the grinding wheel to workpiece grinding position to locate its periphery at a constant and precise griding location irrespective of the extent to which the periphery of the wheel has been reduced during the useful life of the wheel.

A further object is to provide adjustment means for an abrasive grinding wheel which is automatically operative, when the grinding wheel is moved away from and then back to work grinding position, to provide automatically for incremental adjustments in the range of movements of the wheel in proportion to the reduction of the periphery of the wheel due to wear and/or dressing.

In the preferred embodiment of the invention, the invention is utilized for the automatic, periodic and controlled dressing of a grinding wheel during grinding operation. The grinding wheel is mounted rotatably on the distal end of a pivotal support arm, and an actuating means is operative periodically to rock the pivot arm to retract the grinding wheel to dressing position and then to advance the grinding wheel to workpiece grinding position. An automatically controlled, periodically operable compensating means comprising a fixed stop on the pivot arm, an adjustable cam engageable with the stop and a drive means for adjusting the cam selectively relative to the stop, permits the extent of retraction of the grinding wheel to dressing position to be progressively increased incrementally, for the selected dressing of the wheel. Further, such means permits the wheel, following dressing, to be advanced to grinding position along a progressively and incrementally increased path of movement, in proportion to the reduction of the grinding wheel by dressing, to ensure that the periphery of the wheel always is restored to a constant and precise workpiece grinding position in the machine.

Other objects and advantages of this invention will be apparent from the preferred embodiment thereof set forth in the following description.

DETAILED DESCRIPTION OF THE INVENTION

Figure 1:
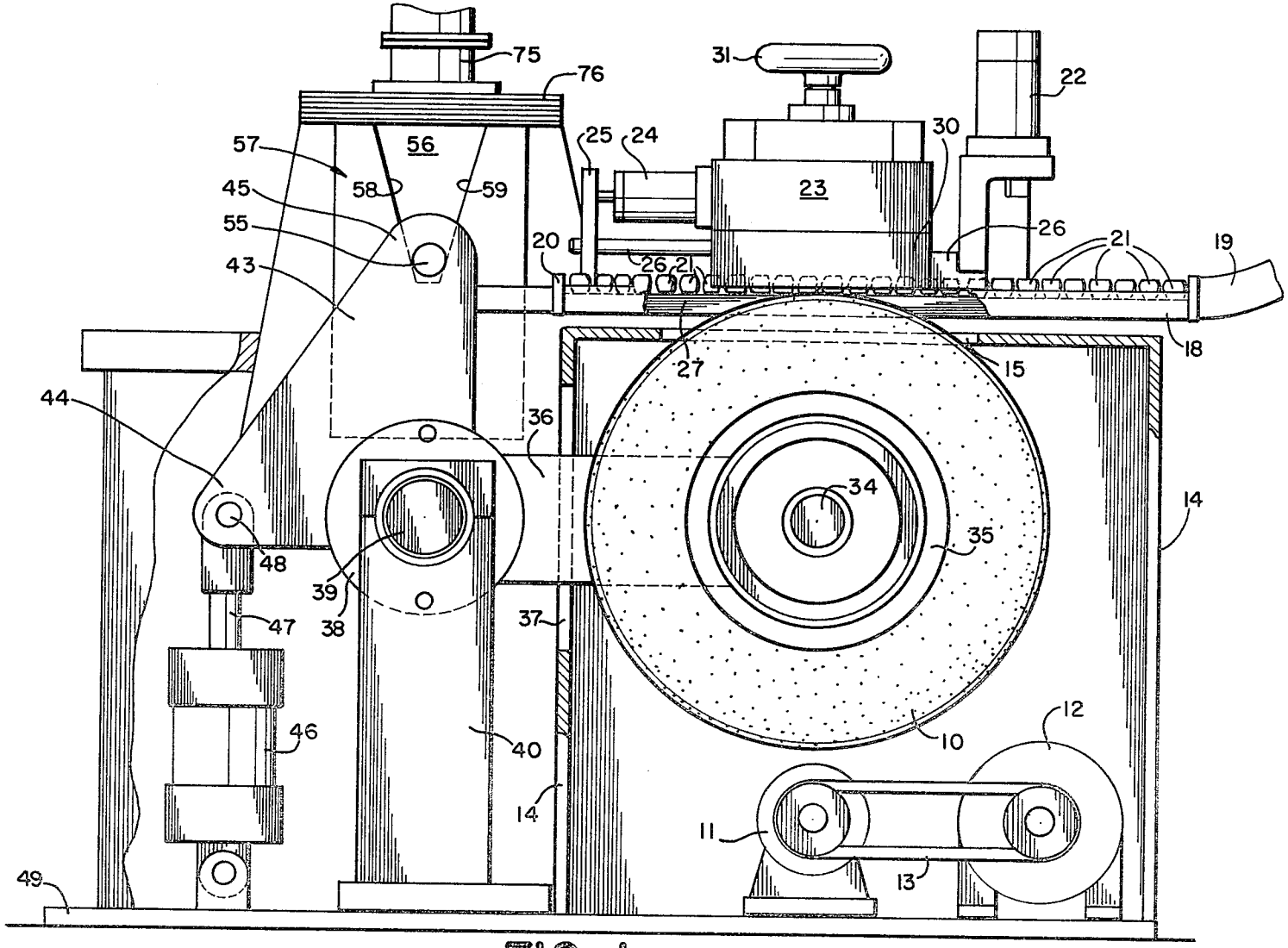
FIG. 1 is a fragmentary view in front elevation of a grinding machine incorporating the automatically adjustable grinding wheel of this invention.

Referring first to FIG. 1 of the drawing, there is illustrated a grinding machine having a vertically disposed rotatable grinding wheel 10 for the abrasive finishing of workpieces and a complemental rotatable diamond dressing wheel 11 for periodically dressing the periphery of the grinding wheel 10 after wear has developed during use. Preferably, the horizontal axes of the grinding wheel 10 and the dressing wheel 11 are disposed in the same vertical plane. The dressing wheel 11 is driven by an electric motor 12 through a suitable timing drive belt 13 in conventional fashion. The grinding wheel 10, dressing wheel 11, motor 12 and drive belt 13 are enclosed within a generally rectangular, box-like housing 14, access to the interior of which may be had by any suitable door (not shown). The top of the housing 14 is provided with a transversely extending slot or opening 15 through which extends the upper portion of the grinding wheel 10.

The grinding machine includes such conventional components as a horizontal track or channel 18 for retaining and/or feeding the parts or pieces 21 to be ground tangentially to the grinding wheel 10, a part hold down and feeding mechanism 22 and a work staging device 23. The rectilinear feed track or part retainer 18 is connected by means of an inlet conduit 19 to a conventional part or work feeding device (not shown) which, preferably, includes a conventional bowl type vibrating hopper (also not shown) providing a source of supply for the parts 21 to be ground. The part hold down and feeding mechanism 22 may include a reciprocal feed finger (not shown) of conventional construction actuated periodically by a hydraulic cylinder 24 connected to the feed finger by a yoke 25 and a connecting rod 26.

The transverse feed track 18 extends completely across the top of the housing 14. It is spaced above and in parallel alignment with the transverse slot 15 formed in the top of the housing. An elongated slot 27 in the bottom of the feed track 18 extends linearly from its juncture with the inlet conduit 19 to the discharge end 20 of the track. The portion of the periphery of the grinding wheel 10 which extends upwardly through the housing slot 15 penetrates into the elongated slot 27 in feed track 18 a selected distance to workpiece grinding position. At that location, the periphery of wheel 10 comes into grinding contact with the exposed bottoms of the workpieces 21 as they advance linearly along the feed track 18 from its input end 19 to its discharge end 20 from which the ground pieces or parts 21 drop into a basket receiver (not shown). If desired, the linear slot 27 formed in the bottom of the feed track 18 may be of relatively short length, but must be sufficiently long to permit the periphery of the grinding wheel 10 to extend up to the selected workpiece grinding position during the grinding of the parts 21 fed along track 18.

The work staging device 23 is located vertically above the grinding wheel 10. It includes a vertically slidable, spring biased, horizontal pressure pad 30 for maintaining the workpieces 21 in abrasive engagement with the periphery of the grinding wheel 10 at the workpiece grinding location, as the pieces 21 advance tangentially relative to the grinding wheel. The pressure pad is disposed radially relative to the grinding wheel, whereby its bottom horizontal surface is in opposing relation to the periphery of the grinding wheel 10. Any suitable adjustment mechanism 31, comprising a part of the work staging device 23, may be utilized to selectively control the location of pad 30, and thereby control the depth to which the workpieces 21 are ground by the grinding wheel 10. Suitable springs (not shown) exert constant downward pressure on pad 30 to urge the bottoms of the linearly advancing workpieces 21 yieldingly into grinding engagement with the periphery of the grinding wheel 10, under sufficient pressure to ensure that the desired depth of grinding is accomplished while avoiding undesirable kickback.

The components of the grinding machine described up to this point are conventional mechanism. They are supported relative to the grinding wheel 10 and housing 14 by any suitable structure.

The grinding wheel 10 is affixed to a shaft 34 mounted rotatably within a hub 35 located at the distal end of a vertically pivotal arm 36. The pivotal arm 36 extends outwardly of the housing 14 through an aperture 37 formed in the left side wall of the housing, as viewed in FIG. 1. The proximal end of the pivot arm 36 is provided with a hub 38 affixed to a short, horizontal stud shaft or pivot 39 supported rotatably in the upper ends of a pair of longitudinally spaced vertical standards 40, 41 (FIG. 2) disposed externally of and adjacent to the housing 14.

The hub 38 is provided with a generally triangular extension 43 having a rearwardly extending leg or component 44 and a vertically upward extending leg or component 45. Disposed below the leg 44 is a double acting hydraulic cylinder 46 having a vertically extending, reciprocable piston rod 47, the upper end of which is connected pivotally to the distal end of the leg 44 by a pivot pin 48. By means of the actuation of the hydraulic cylinder 46, and the consequent vertical reciprocation of its piston rod 47, the pivot arm 36 and its hub 38 and triangular extension 43 may be caused to rock about the axis of pivot 39. The pivot arm 36, hub 38 and extension 43 may be a single integral component, or may be separate components rigidly affixed together by means of bolts, welding or other suitable means.

Pivotal arm 36 supported by the standards 40, 41 and actuated by the hydraulic cylinder 46 provides an arrangement whereby the rotatable grinding wheel 10 may be advanced through slots 15, 27 into workpiece grinding position relative to the horizontal track 18. The arrangement also is operative to retract the grinding wheel periodically into wheel dressing position, to place its periphery in contact with the diamond dressing wheel 11 at selected time intervals, whereby the periphery of the wheel 10 may be retrued after wear has occurred as a result of the workpiece grinding operation. Suitable control mechanism (not shown), such as a timer, part counter or grinding wheel load meter, is operable to actuate the hydraulic cylinder 46 to cause periodic rocking movement of the pivot arm 36 about its pivot 39, whereby the grinding wheel 10, at proper time intervals, may be advanced and retracted arcuately to and from its workpiece grinding and wheel dressing positions.

Both the vertical standards 40, 41 and the vertically disposed hydraulic cylinder 46 are affixed to the base 49 of the machine by conventional securing means, such as bolts, welding, or the like. The rotatable grinding wheel shaft 34 extends rearwardly of the grinding machine, passing outwardly of the housing 14 through an enlarged aperture (not shown) formed in the rear wall of the housing. The external end of the shaft 34 is connected to and driven by an electric motor 53 (FIG. 2), the connection being located within a housing 52. By way of example, a grinding wheel 10, prior to dressing, may be 14" in diameter. Its drive system, which includes the motor 53, may be constituted by a conventional three horsepower motorized precision spindle which rocks or oscillates in unison with the grinding wheel 10 when pivot arm 36 is caused to rock about its pivot 39 by the hydraulic cylinder 46, as previously explained. Large sealed anti-friction bearings (not shown) support the grinding wheel drive assembly 34, 52, 53 during its pivotal or arcuate movements.

Figure 2:
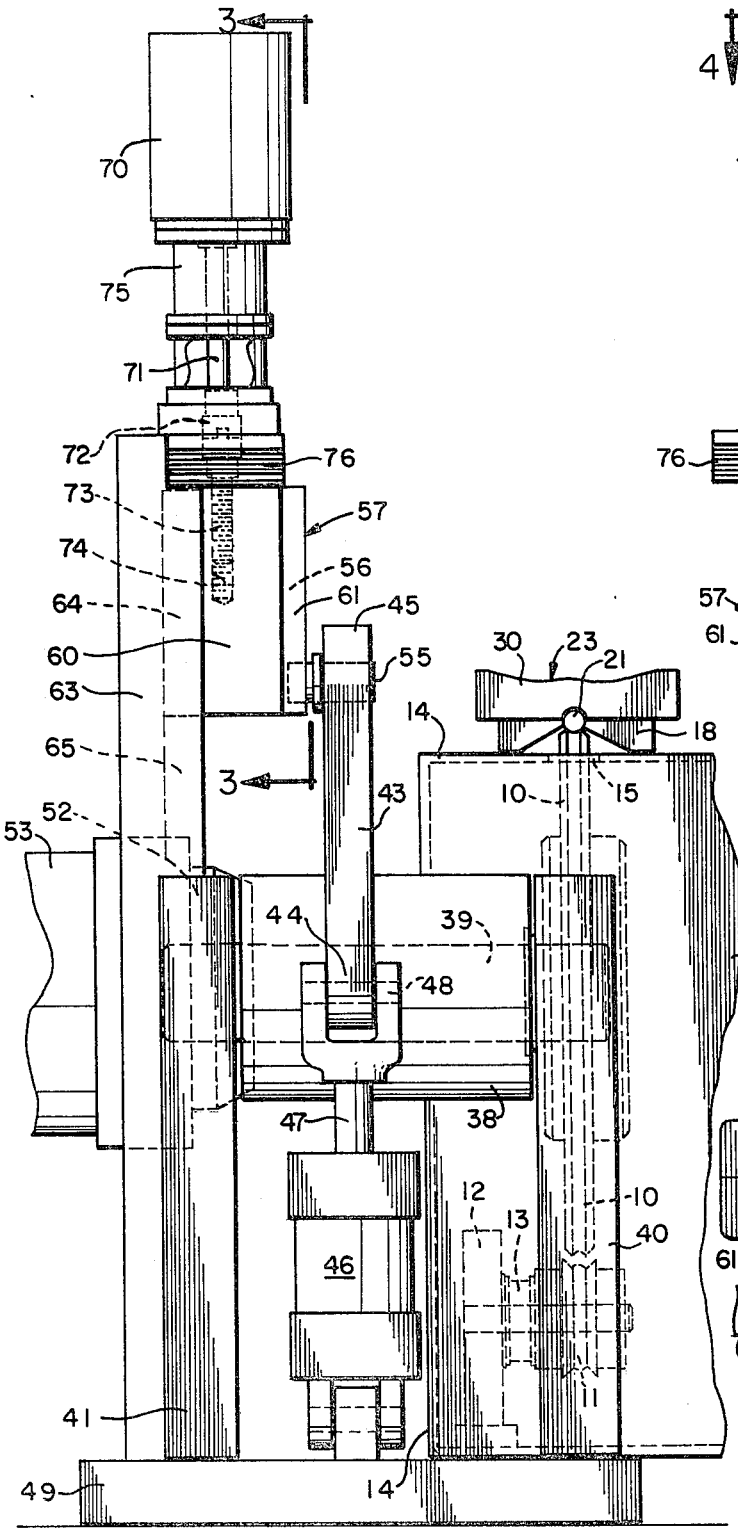
FIG. 2 is a fragmentary view of the machine in side elevation.
Figure 3:
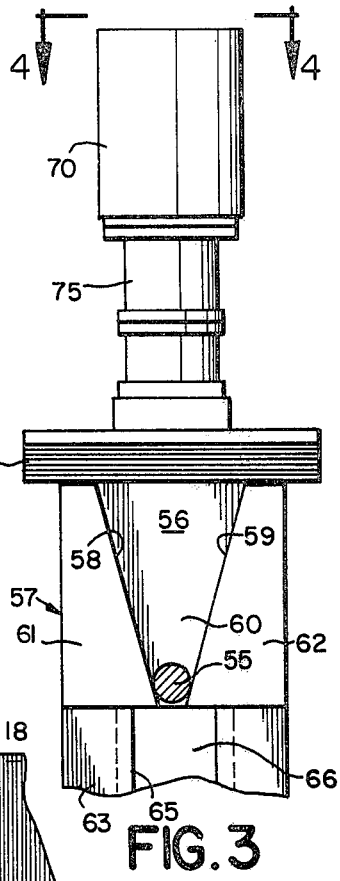
FIG. 3 is a fragmentary view, partially in section, looking in the direction of the angled arrows 3—3 of FIG. 2.
Figure 4:
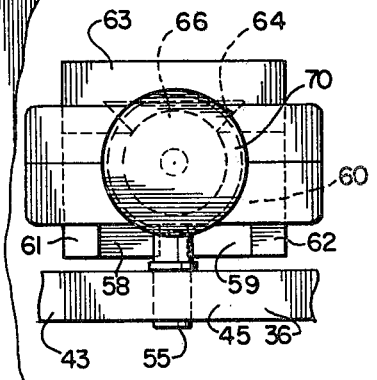
FIG. 4 is a fragmentary view in top plan looking in the direction of the angled arrows 4—4 of FIG. 3.

As best shown in FIGS. 2–4, affixed to the distal end of the upwardly extending leg 45 of the rockable hub extension 43, and extending rearwardly therefrom, is a horizontal pin 55, the distal end of which engages within a vertically extending V-shaped notch or way 56 formed in a vertically slidable cam 57. The opposed, downwardly converging, linear sides 58, 59 of the notch serve as cam surfaces or profiles for engagement with the pin 55 as it rocks or oscillates back and forth along an arcuate path during the reciprocal movement of the grinding wheel arm 36. Pin 55 functions as a stop for the pivotal arm 36. The engagement of pin 55 with sloping cam side 58 limits the extent to which arm 36 may be raised to advance the grinding wheel 10 to workpiece grinding position. Similarly, engagement of pin 55 with the opposite sloping cam side 59 limits the extent to which the grinding wheel may be lowered or retracted to wheel dressing position in contact with the dressing wheel 11. As will be manifest, the extent to which the oscillatable stop pin 55 permits the grinding wheel 10 to move up or down depends on the vertical disposition of the V-shaped notch or recess 56 relative to the pin 55. The lower the cam 57 and its V-shaped notch 56 are located relative to pin 55, the greater will be the oscillatory amplitude of the pin.

The vertically slidable cam 57 is composed of a rectangular slide block 60 to the front vertical surface of which are affixed a pair of transversely spaced, wedge-like members 61, 62, the respective opposing sloping faces of which comprise the upwardly diverging cam sides 58, 59. The block 60 is mounted slidably on the vertical standard 63 by means of a vertically disposed dovetail joint 64, the mortise component 65 of which is formed in standard 63 (FIG. 3) and the tenon component 66 of which is formed along the rear vertical surface of slide 60 (FIG. 4). As will be understood, the dovetail joint 64 permits the slidable cam 57 to be moved up and down linearly relative to the vertical standard 63 and the rockable stop pin 55.

The slidable cam 57 is caused to move up and down selectively by means of a stepping motor 70. The downwardly extending output shaft 71 of the motor 70 is connected by any suitable coupling 72 to the upper end of a vertical drive screw 73 threadingly engaged internally of a complementally threaded vertical bore or hole 74 formed internally of cam slide 60. Thus, stepping motor 70 is operative to cause the slidable cam 57 to move up or down linearly relative to standard 63, depending on the direction of rotation of the drive transmission means constituted by shaft 71, coupling 72 and screw 73. If desired, the shaft 71 and coupling 72 may be disposed within a tubular housing 75, the lower end of which is affixed to the upper end of an expansible bellows covering 76. As motor 70 causes the cam 57 to move downwardly, the bellows 76 is expanded in harmony therewith, and when the cam 57 is retracted upwardly, the bellows 76 is retracted to its collapsed position.

The arrangement of the stepping motor 70, the vertically slidable cam 57 and the stop pin 55 provides a programmable control means whereby, each time the pivot arm 36 is actuated by the hydraulic cylinder 46 to retract the grinding wheel 10, the grinding wheel is caused to move progressively further downward toward the dressing wheel 11, by a selected increment, to carry out the dressing operation. The stepping motor 70 is programmed to impart selected downward linear movement to the slidable cam 57. The extent of the incremental downward movement of cam 57 controls the extent to which the retracted grinding wheel 10 is lowered further to dressing position, because of the engagement of the stop pin 55 with the sloping cam side 59, and thereby controls the incremental amount by which the diameter of the grinding wheel is reduced during each dressing operation.

Preferably, the stepping motor 70 is actuated periodically to lower the V-shaped cam 57 immediately after the hydraulic cylinder 46 has retracted the grinding wheel 10 into proximity with the dressing wheel 11. The stepping motor 70 is stepped at the selected rate, thereby lowering the cam 57 the selected incremental distance to permit the retracted grinding wheel 10 to be lowered further, into contact with the dressing wheel 11. This enables the programmed amount of grinding wheel dressing to take place at a controlled rate. The arrangement permits the periodic dressing of the periphery of the grinding wheel 10 by reducing the diameter of the grinding wheel by a selected amount each time the grinding wheel is retracted to wheel dressing position.

The programmed compensating means constituted by the stepping motor 70 and the slidable cam 57 also is operative to return the grinding wheel 10 to a constant and exact workpiece grinding position, when the hydraulic cylinder is reverse actuated to raise the grinding wheel 10. As arm 36 moves upwardly to raise grinding wheel 10, its stop pin 55 is moved away from cam surface 59 and into contact with the opposing sloping cam surface 58, whereby the upward movement of the grinding wheel 10 is arrested. The sloping cam surfaces 58, 59 are complementally formed relative to each other, whereby cam 58 is operative to ensure that, following the dressing operation, the periphery of the elevated dressed grinding wheel 10 always is returned to the same workpiece grinding position relative to slots 15, 27, track 18 and the workpieces 21. Preferably, the cam surfaces 58, 59 constitute the equal sides of an isosceles triangle, and define the V-shaped depression or notch 56. The wedge-like members 61, 62 preferably are of frusto-right angular configuration. The arrangement permits the grinding wheel 10, during dressing, to be lowered and raised by reciprocal strokes of equal amplitude. Each time the wheel 10 is returned to workpiece grinding position, its axis or center line is raised from its previous grinding location by a distance equal to the amount dressed from the periphery of the wheel during the immediately preceding dressing operation.

The stepping motor 70 may be controlled by any conventional motor control means, whereby each time the stepping motor is actuated, it is advanced a selected number of steps which, combined with the pitch of the screw 73, determines the amount of each incremental downward advance of the cam 57. The stepping motor 70 is of conventional design, preferably designed for two hundred steps per revolution. In normal practice, it may be programmed to advance the slidable cam 57 downwardly during each dressing operation by vertical increments within the range of 0.002" to 0.002".

The controls for the stepping motor 70 and the hydraulic cylinder 46 may be interfaced to a basic machine control (not shown), whereby selected dressing of the grinding wheel 10 may be carried out automatically by repetitive wheel dressing cycles during the operation of the machine. During each cycle, the periphery of the grinding wheel 10 is reduced automatically by the programmed amount to retrue the wheel, following which the grinding wheel is returned automatically to workpiece grinding position.

The invention provides for the automatic, controlled and periodic dressing of a grinding wheel 10 during the operation of the grinding machine. Such dressing may be carried out throughout the useful life of the grinding wheel, i.e. until it has been worn, through abrasive grinding and dressing, to such extent it no longer is effective. The frequency of the periodic dressing of the wheel 10 depends, of course, on the type of grinding being performed. The hydraulic cylinder 46 and the stepping motor 70, for example, might be actuated once every minute, or once every two or three hours, to dress the grinding wheel 10 and then restore it to workpiece grinding position. Thus, the useful life of a grinding wheel will vary, depending on the nature of the grinding operation and the required frequency of wheel dressing.

If desired, the V-shaped notch 56 of the slidable cam 57 may be designed of such shape and size that the full extent of its vertical downward movement or range is equivalent to, or in excess of, the useful life of the grinding wheel 10. In such case, within the time the V-shaped cam profiles 58, 59 may complete the full range of their downward, incrementally successive, linear adjustments, the grinding wheel 10 will have been reduced to such extent as to require replacement. Upon its replacement, the stepping motor 70 is reverse actuated to raise the cam 57 to its starting location, preparatory to the resumption in operation of the grinding machine.

The stepping motor 70 may be replaced by any equivalent drive means such as, for example, a ratchet and pawl arrangement. Regardless of the type of drive means 70 utilized, it must be synchronized with the cycles of operation of the hydraulic cylinder 46 to actuate the cam slide 60 periodically in harmony with the reciprocal movements of the pivot arm 36. The result of the incremental advancements or adjustments of the slide 60 downward relative to the standard 63 is to locate the V-shaped cam profiles 58, 59 selectively at successively lower positions relative to the stop pin 55, thereby increasing progressively the oscillatory range of movement of the stop pin between the two cams. The progressive increase in the amplitude of oscillation of the pin 55 within the V-shaped notch 56 provides for a proportional incremental increase in the reverse stroke or extent of retraction of the grinding wheel 10 into engagement with the dressing wheel 11, enabling a predetermined amount of wheel dressing to take place. Such progressive increase in the amplitude of oscillation of the pin 55 also ensures that, following dressing, the periphery of the grinding wheel 10 always is returned to the same, precise wheel dressing position. It provides an incremental increase in the return stroke or extent of return of the grinding wheel to grinding position, in proportion to the reduction of the periphery of the wheel by the dressing operation.

The hydraulic cylinder 46 is replaceable by any equivalent actuating means adapted to provide the selected, periodic rocking action of the reciprocal pivot arm 36 and its reciprocal stop pin 55. For example, in place of the hydraulic cylinder 46 a stepping motor may be utilized, with a suitable timing control, for the periodic actuation of arm 36 and its stop pin 55.

Any suitable workpiece retaining means for locating the workpieces 21 accurately relative to the grinding periphery of the wheel 10 may be utilized in place of the horizontal feed track or channel 18. For example, a part holding or retaining slide, moveable reciprocatorily relative to a fixed track or way, may be utilized to deliver the parts or workpieces 21 to and from the grinding wheel 10. In such arrangement, the work retaining slide first advances a part 21 to the grinding wheel for abrasive grinding, following which the slide may be further advanced to release the finished part, and then retracted for reception of the next part or piece to be ground. Or, following the grinding operation, the slide simply may be retracted to its original location, where the finished piece 21 is discharged and a new piece inserted preparatory to repeating the grinding operation.

In place of the rotatable diamond dressing wheel 11, any other well known type of grinding wheel dressing means may be utilized such as, for example, a point dresser.

Although a preferred embodiment of this invention has been shown and described herein for the purpose of illustration, as required by Title 35 U.S.C. Section 112, it is to be understood that various changes, modifications and alterations may be made thereto, and various uses may be made thereof, without departing from the spirit and utility of the invention, or the scope thereof as set forth in the appended claims. The invention has proven to be particularly advantageous in the removal, by abrasive grinding, of casting gates from the workpieces 21. Where a large quantity of castings 21 are to be machined one after the other, by abrasive removal of their gates, frequent dressing of the grinding wheel usually is necessary during the grinding operation. However, while the invention has been specifically illustrated and described in respect to the automatic and periodic dressing of a grinding wheel during its grinding operation, the invention is fully applicable to a wide range of grinding machines where the use of automatically adjustable means is necessary or desired to return, restore or maintain an abrasive grinding wheel to or at a constant, precise workpiece grinding position.

I claim:

1. In a grinding machine having workpiece retaining means, a rotatable grinding wheel, wheel support means for disposing the periphery of the grinding wheel in workpiece grinding position relative to the retaining means and grinding wheel dressing means, means for dressing the grinding wheel during operation of the grinding machine comprising (a) a pivotal support having a distal end rotatably supporting the grinding wheel, (b) actuating means connected to the support and operable to pivot the support to retract the grinding wheel to dressing position relative to the dressing means and to return the grinding wheel to workpiece grinding position, (c) a cam disposed adjacent the pivotal support, said cam having a V-shaped notch defined by a pair of opposing and converging cam surfaces, (d) a stop affixed to the pivotal support for limiting both the extent to which the grinding wheel is retracted to dressing position and the extent of return of the grinding wheel to workpiece grinding position, said stop being oscillatable within the cam notch when the support is pivoted, the amplitude of oscillation of the stop being limited by the opposing cam surfaces, and (e) cam actuating means connected to the cam and operable to adjust the location of the V-shaped cam notch relative to the stop to increase progressively the amplitude of oscillation of the stop within the notch and thereby increase incrementally the extent of each retraction of the grinding wheel to dressing position while increasing incrementally the extent of return of the grinding wheel to workpiece grinding position in proportion to the reduction of the periphery of the wheel by the dressing means.

2. The grinding machine of claim 1, further including (a) a moveable slide affixed to the cam, (b) a stepping motor operable to move the slide selectively to adjust the location of the cam and its V-shaped notch relative to the stop and (c) drive transmission means connecting the stepping motor to the cam slide.

3. In a grinding machine having workpiece retaining means, a rotatable grinding wheel, wheel support means for disposing the periphery of the grinding wheel in workpiece grinding position relative to the retaining means and grinding wheel dressing means, means for dressing the grinding wheel during operation of the grinding machine comprising (a) a reciprocal support for mounting the grinding wheel rotatably, (b) actuating means connected to the grinding wheel support and operable to retract the grinding wheel to dressing position relative to the dressing means and to advance the grinding wheel to workpiece grinding position following dressing, (c) a moveable cam disposed adjacent the reciprocal support, said cam including a notch defined by spaced cam surfaces having opposing and diverging profiles for increasing progressively the extent of reciprocal movement of the grinding wheel support, (d) a stop affixed to the reciprocal support and engageable within the notch, said stop being reciprocal between the cam profiles when the support is reciprocated, the amplitude of reciprocation of the stop being limited by the opposing cam profiles, and (e) cam actuating means connected to the cam and operable to move the cam to adjust the location of the cam profiles relative to the stop to increase progressively the amplitude of reciprocation of the stop and thereby increase incrementally the extent of retraction of the grinding wheel to dressing position while increasing incrementally, in proportion to the reduction of the periphery of the wheel by the dressing means, the return of the grinding wheel to workpiece grinding position.

4. In a grinding machine having workpiece retaining means, a rotatable grinding wheel and wheel support means for disposing the periphery of the grinding wheel in workpiece grinding position relative to the retaining means, (a) a pivotal support for the grinding wheel, (b) actuating means for the grinding wheel support operable to pivot the support to advance the wheel to and retract said wheel from workpiece grinding position, (c) a stop affixed to the grinding wheel support and adapted to be oscillated over an arcuate path when the grinding wheel support is pivoted, (d) a first cam having a sloping cam surface located adjacent to and within the arcuate path of the stop, said first cam being operative to engage the stop to limit the advance of the grinding wheel to workpiece grinding position, (e) a second cam spaced from the first cam and having a sloping cam surface located adjacent to and within the arcuate path of the stop, said second cam being operative to engage the stop to limit the extent to which the grinding wheel is retracted from workpiece grinding position and (f) cam actuating means connected to and operable to advance the sloping cam surfaces linearly relative to the arcuate path of the stop to increase progressively the oscillatory amplitude of the stop, thereby to (i) increase progressively the extent of advance of the grinding wheel to workpiece grinding position to locate the periphery of said wheel in workpiece grinding position irrespective of the extent to which the periphery of the wheel has been reduced during the useful life of the wheel and (ii) to increase progressively the extent of retraction of the grinding wheel from workpiece grinding position.

5. The grinding machine of claim 4, wherein (a) the cams comprise a single moveable cam element provided with a V-shaped notch, said cam notch being defined by an opposing pair of converging cam surfaces, (b) the stop affixed to the grinding wheel support is disposed within the cam notch with capacity for oscillation along the arcuate path between the cam surfaces and (c) the cam actuating means is operative to adjust the location of the V-shaped cam notch selectively relative to the arcuate path of the stop to thereby progressively increase the amplitude of oscillation of the stop within the notch.

6. The grinding machine of claim 5, wherein (a) a slide is connected to the moveable cam element for moving the converging cam surfaces relative to the arcuate path of the stop and (b) the cam actuating means comprises a stepping motor connected to the slide and operable to advance the slide relative to the arcuate path of the stop to locate the converging cam surfaces at successive positions relative to the stop to progressively increase the oscillatory amplitude of the stop.

7. The grinding machine of claim 5, further including (a) a slide affixed to the movable cam, (b) drive means for the cam and (c) drive transmission means connecting the cam drive means to the slide, (d) said drive means and said drive transmission means being operable to actuate the slide to adjust the location of the V-shaped cam notch relative to the stop.

8. In a grinding machine having workpiece retaining means, a rotatable grinding wheel and wheel support means for disposing the periphery of the grinding wheel in workpiece grinding position relative to the retaining means, (a) a reciprocable support for the grinding wheel,
(b) actuating means for the grinding wheel support operable to advance the wheel to and retract the wheel from workpiece grinding position,
(c) a stop affixed to the grinding wheel support and adapted to be reciprocated over a pre-determined path when the grinding wheel support is reciprocated,
(d) a first sloping cam surface located adjacent to and within the path of the stop, said first sloping cam surface being operative to engage the stop to limit the advance of the grinding wheel to workpiece grinding position,
(e) a second sloping cam surface spaced from the first sloping cam surface and located adjacent to and within the path of the stop, said second sloping cam surface being operative to engage the stop to limit the extent to which the grinding wheel is retracted from workpiece grinding position and
(f) actuating means connected to and operable to advance the sloping cam surfaces linearly relative to the path of the stop to increase progressively the reciprocatory amplitude of the stop, thereby to
(i) increase progressively the extent of advance of the grinding wheel to workpiece grinding position and
(ii) to increase progressively the extent of retraction of the grinding wheel from workpiece grinding position.

9. The grinding machine of claim 8, wherein
(a) the two sloping cam surfaces comprise portions of a single moveable cam provided with a V-shaped notch, said notch being defined by an opposing pair of converging cam surfaces,
(b) the stop affixed to the grinding wheel support is disposed within the notch with capacity for reciprocation along the predetermined path between the cam surfaces and
(c) the actuating means is operative to adjust the location of the V-shaped notch selectively relative to the path of the stop to thereby progressively increase the amplitude of reciprocation of the stop within the notch.

* * * * *